US007142229B2

(12) United States Patent
Ohkubo et al.

(10) Patent No.: US 7,142,229 B2
(45) Date of Patent: Nov. 28, 2006

(54) EXPOSURE APPARATUS

(75) Inventors: Kazunobu Ohkubo, Kanagawa (JP); Hiroaki Hyuga, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 204 days.

(21) Appl. No.: 10/998,989

(22) Filed: Nov. 30, 2004

(65) Prior Publication Data

US 2005/0122388 A1 Jun. 9, 2005

(30) Foreign Application Priority Data

Dec. 3, 2003 (JP) ..... 2003-404142

(51) Int. Cl.
*B41J 2/447* (2006.01)
*B41J 2/45* (2006.01)

(52) U.S. Cl. ..... 347/238; 347/237

(58) Field of Classification Search ..... 347/237, 347/238

See application file for complete search history.

(56) References Cited

U.S. PATENT DOCUMENTS 6,538,682 B1 * 3/2003 Ohkubo ..... 347/241
6,731,322 B1 * 5/2004 Hori ..... 347/238
6,781,617 B1 * 8/2004 Ohkubo ..... 347/238
6,816,181 B1 * 11/2004 Ohkubo ..... 347/238
2002/0085187 A1 * 7/2002 Ohkubo ..... 355/41
2004/0146969 A1 * 7/2004 Furutani et al. ..... 435/69.1
2004/0233271 A1 * 11/2004 Nojima et al. ..... 347/238
2005/0007441 A1 * 1/2005 Hyuga ..... 347/238

FOREIGN PATENT DOCUMENTS

JP 03-110513 * 5/1991 ..... 347/233
JP 2001-356422 A 12/2001

* cited by examiner

*Primary Examiner*—Huan Tran
(74) *Attorney, Agent, or Firm*—Sughrue Mion, PLLC

(57) ABSTRACT

An exposure apparatus includes a light emitting device array in which a plurality of light emitting devices comprising light emitting sections formed onto a transparent substrate with a predetermined pattern and capable of being controlled and driven independently are arranged in a primary scanning direction to form a device row and a plurality of the device rows are arranged in a secondary scanning direction intersecting with the primary scanning direction. Further, the plurality of light emitting devices are aligned in the secondary direction with respect to a photosensitive material, and the plurality of device rows are sequentially illuminated on a time-division basis. In particular, the plurality of device rows are arranged with a pitch T expressed by T=(m−1/n)P when they are sequentially illuminated in a direction identical to the secondary scanning direction, and are arranged with a pitch T expressed by T=(m+1/n)P when they are sequentially illuminated in a direction opposite to the secondary scanning direction, where P is the pitch of an exposure pixel, m is an integer equal to or greater than 2, and n is the number of device rows arranged in the secondary scanning direction.

18 Claims, 7 Drawing Sheets

EXPOSURE APPARATUS

CROSS-REFERENCE TO RELATED APPLICATION

This application claims priority under 35 USC 119 from Japanese Patent Application No. 2003-404142, the disclosure of which is incorporated by reference herein.

BACKGROUND OF THE INVENTION

1. Field of the Invention

The present invention relates to an exposure apparatus, and more particularly, it pertains to an apparatus wherein a plurality of light emitting devices are arranged at predetermined intervals in a primary scanning direction to form a device row and a plurality of the device rows are arranged in a secondary scanning direction.

2. Description of the Related Art

An organic electroluminescence device incorporating fluorescent organic substances in a light emitting layer, which is referred to as an organic electroluminescence (EL) device, is easier to make than other types of light emitting devices, and can be formed into thin, light weight structures. In view of such advantages, such light emitting devices have been researched and developed as devices for thin display panels. Further, since high performance organic EL devices have recently been obtained, which rival light emitting diodes (LED) in terms of emission luminance, light emission efficiency, durability, and the like, research has been undertaken to apply such devices in exposure apparatuses for exposing photoreceptors such as silver halide photoreceptors.

An exposure apparatus using organic electroluminescence (EL) devices comprises, as shown in FIG. 8, for example, plural sets (two sets in FIG. 8) of device rows arranged in a secondary scanning direction, wherein each set of device rows include light emitting sections 80 emitting light in red (R), green (G) and blue (B) colors which are arranged on a color basis in a primary scanning direction. In FIG. 8, the light emitting sections are indicated by the reference numeral 80 with alphabet suffix R, G or B added for color distinction. However, in this type of exposure apparatus, variation in light quantity among the respective devices causes streak unevenness in the secondary scanning direction in images formed.

In order to solve the above drawback, Japanese Patent Laid-Open Publication (JP-A) No. 2001-356422 has proposed a technique for eliminating such streak unevenness by arranging plural device rows in a secondary scanning direction and repeatedly exposing (multiple exposing) one primary scanning line by use of plural device rows so that variations in light quantity among the devices may be averaged.

However, with conventional multiple exposure apparatuses, there is a problem that exposure position in a secondary scanning direction becomes misaligned, resulting in decreased resolution, despite the multiple exposure of one primary scanning line by use of plural device rows arranged in the secondary scanning direction.

SUMMARY OF THE INVENTION

The present invention has been made with a view to solving the foregoing problem and provides an exposure apparatus which is arranged such that misalignment of exposure position in a secondary scanning direction is prevented and high-resolution exposure can be effected.

A first aspect of the present invention provides an exposure apparatus, comprising: a light emitting device array in which a plurality of light emitting devices capable of being controlled and driven independently are arranged in a primary scanning direction to form a device row and a plurality of the device rows are arranged in a secondary scanning direction, such that the light emitting devices are aligned in the secondary scanning direction with respect to a photosensitive material in the secondary scanning direction; and a drive-control device for driving and controlling each of the light emitting devices so as to cause the plurality of device rows arranged in the secondary scanning direction to be sequentially illuminated on a time-division basis; wherein when the plurality of device rows are illuminated in a direction identical to the secondary scanning direction, the device rows are arranged with a pitch that is expressed by an equation (1) given below, and when the plurality of device rows are illuminated in a direction opposite to the secondary scanning direction, the device rows are arranged with a pitch T that is expressed by an equation (2) given below, $$T=(m-1/n)P \tag{1}$$

$$T=(m+1/n)P \tag{2}$$

where P is a pitch of an exposure pixel, m is an integer equal to or greater than 2, and n is a number of the device rows arranged in the secondary scanning direction.

A second aspect of the present invention provides an exposure apparatus, comprising: a light emitting device array in which a plurality of light emitting devices capable of being controlled and driven independently are arranged in a primary scanning direction to form a device row and a plurality of the device rows are arranged in a secondary scanning direction, such that the light emitting devices are aligned in the secondary direction with respect to a photosensitive material; and a drive-control device for driving and controlling each of the light emitting devices so as to cause the plurality of device rows arranged in the secondary scanning direction to be sequentially illuminated on a time-division basis; wherein when the plurality of device rows are illuminated in a direction identical to the secondary scanning direction, the device rows are arranged with a pitch that is expressed by an equation (4) given below, and when the plurality of device rows are illuminated in a direction opposite to the secondary scanning direction, the device rows are arranged with a pitch T' that is expressed by an equation (5) given below, $$T'=\{m-1/(n\cdot t+t_1)\}P \tag{4}$$

$$T'=\{m+1/(n\cdot t+t_1)\}P \tag{5}$$

where P is a pitch of an exposure pixel, m is an integer equal to or greater than 2, n is a number of the device rows arranged in the secondary scanning direction, t is a light emitting time of each device row, and $t_1$ is an interval time between frames.

A third aspect of the present invention provides an exposure apparatus, comprising: a light emitting device array in which a plurality of light emitting devices comprising light emitting sections formed on a transparent substrate with a predetermined pattern and capable of being controlled and driven independently are arranged in a primary scanning direction to form a device row and a plurality of the device rows are arranged in a secondary scanning direction intersecting with the primary scanning direction, such that the light emitting devices are aligned in the secondary scanning direction with respect to a photosensitive material in the secondary scanning direction; a drive-control device for driving and controlling each of the light emitting devices so as to cause the plurality of device rows arranged in the secondary scanning direction to be sequentially illuminated on a time-division basis; and an exposure spot forming device for providing images on a surface of the photosensitive material by focusing light emitted from the light emitting devices when illuminated and then permeated through the transparent substrate; wherein when the plurality of device rows are illuminated in a direction identical to the secondary scanning direction, the device rows are arranged with a pitch that is expressed by an equation (1) given below, and when the plurality of device rows are illuminated in a direction opposite to the secondary scanning direction, the device rows are arranged with a pitch T that is expressed by an equation (2) given below, $$T=(m-1/n)P \quad (1)$$

$$T=(m+1/n)P \quad (2)$$

where P is a pitch of an exposure pixel, m is an integer equal to or greater than 2, and n is a number of the device rows arranged in the secondary scanning direction; and wherein the photosensitive material is scan-exposed with a secondary scanning velocity v that is expressed by an equation (3) given below, $$v=P/(n\cdot t) \quad (3)$$

where P is a pitch of an exposure pixel, m is an integer equal to or greater than 2, n is a number of the device rows arranged in the secondary scanning direction, and t is a light emitting time of each device row.

A fourth aspect of the present invention provides an exposure apparatus, comprising: a light emitting device array in which a plurality of light emitting devices comprising light emitting sections formed onto a transparent substrate with a predetermined pattern and capable of being controlled and driven independently are arranged in a primary scanning direction to form a device row and a plurality of the device rows are arranged in a secondary scanning direction intersecting with the primary scanning direction, such that the light emitting devices are aligned in the secondary scanning direction with respect to a photosensitive material; a drive-control device for driving and controlling each of the light emitting devices so as to cause the plurality of device rows arranged in the secondary scanning direction to be sequentially illuminated on a time-division basis; and an exposure spot forming device for providing images on a surface of the photosensitive material by focusing light emitted from the light emitting devices when illuminated and then permeated through the transparent substrate, onto a surface of the photosensitive material; wherein when the plurality of device rows are illuminated in a direction identical to the secondary scanning direction, the device rows are arranged with a pitch that is expressed by an equation (4) given below, and when the plurality of device rows are illuminated in a direction opposite to the secondary scanning direction, the device rows are arranged with a pitch T' that is expressed by an equation (5) given below, $$T'=\{m-1/(n\cdot t+t_1)\}P \quad (4)$$

$$T'=\{m+1/(n\cdot t+t_1)\}P \quad (5)$$

where P is a pitch of an exposure pixel, m is an integer equal to or greater than 2, n is a number of the device rows arranged in the secondary scanning direction, t is a light emitting time of each device row, and $t_1$ is an interval time between frames; and wherein the photosensitive material is scan-exposed with a velocity v' that is expressed by an equation (6) given below, $$v'=P/(n\cdot t+t_1) \quad (6)$$

where P is a pitch of an exposure pixel, m is an integer equal to or greater than 2, n is a number of the device rows arranged in the secondary scanning direction, t is a light emitting time of each device row, and $t_1$ is an interval time between frames.

In the present invention, it is preferred that the light emitting device array use an organic electroluminescence device, each light emitting section of which corresponds to a "light emitting device" according to the present invention.

Other objects, features and advantages of the present invention will become apparent from the ensuing description taken in conjunction with the accompanying drawings.

DETAILED DESCRIPTION OF THE INVENTION

With reference to the drawings, embodiments of the present invention will be explained in detail below.

Figure 1:
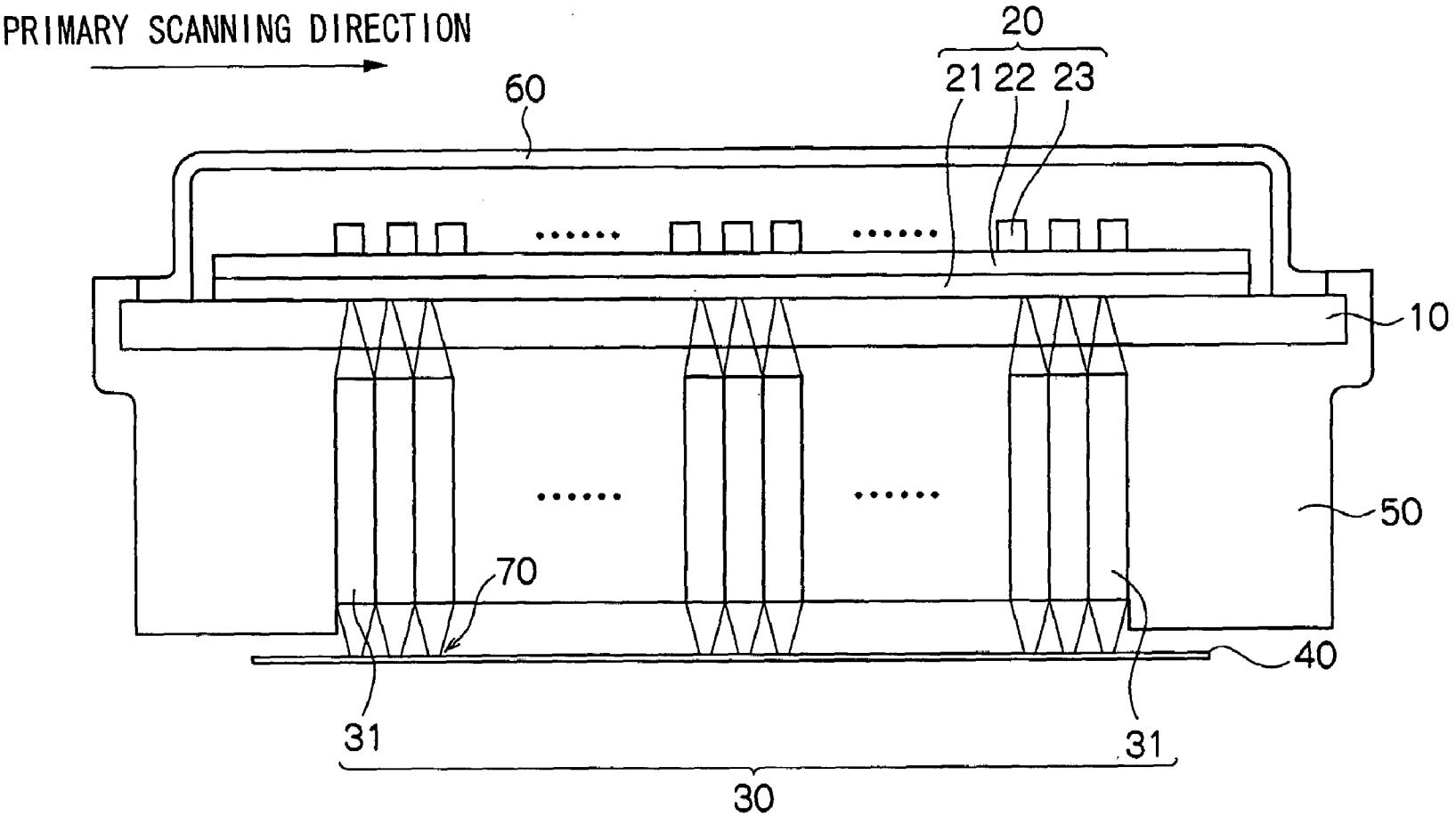
FIG. 1 is a cross-sectional view showing an exposure apparatus according to an embodiment of the present invention.

As shown in FIG. 1, an exposure apparatus according to the present invention includes a transparent substrate 10, an organic electroluminescence (EL) device 20 formed onto the transparent substrate 10 by vapor deposition, a SELFOC lens array (hereinafter referred to as "SLA") 30 for focusing light emitted from the organic electroluminescence device 20 to irradiate the focused light onto a photosensitive material 40, and a supporting body 50 for supporting the transparent substrate 10 and the SLA 30.

The organic electroluminescence device is formed by laminating a transparent anode 21, an organic compound layer 22 including a light emitting layer, and metal cathodes 23 in the named order onto the transparent substrate 10. A desired color of light emission can be obtained by selecting a material of the organic compound layer 22, including the light emitting layer, accordingly. On the transparent substrate 10 are formed a light emitting section 20R emitting red (R) light, a light emitting section 20G emitting green (G) light, and a light emitting section 20B emitting blue (B) light with a predetermined pattern which will be described hereinafter. In the case of the organic electroluminescence device, each light emitting section corresponds to a "light emitting device" according to the present invention.

The organic electroluminescence device 20 is, for example, covered by a sealing member 60, such as a stainless steel can or the like, as shown in FIG. 1. Edges of the sealing member 60 and the transparent substrate 10 are adhered to each other, and the organic electroluminescence device 20 is sealed inside the sealing member 60 and filled with dry nitrogen gas. When a predetermined voltage is applied between the transparent anode 21 and the metal cathodes 23 in the organic electroluminescence device 20, the light emitting layer incorporated in the organic compound layer 22 emits light, and the light emission is emitted through the transparent anode 21 and the transparent substrate 10. The organic electroluminescence device 20 features excellent wavelength stability.

Both the transparent electrode and the metal electrodes in each organic electroluminescence device are connected to a driving circuit (not shown) for driving plural light emitting sections independently (in a passive driving fashion). The driving circuit is coupled to a control section (not shown) through a frame memory (not shown).

The driving circuit comprises a power source (not shown) for applying a voltage between both electrodes, and a switching device (not shown) formed by transistors or thyristors. The driving circuit generates a driving signal in accordance with a control signal entered from the control section through the frame memory.

The transparent substrate 10 is a substrate transparent to the emission lights, and a glass substrate, plastic substrate and the like can be used as the transparent substrate 10. Heat resistance, dimensional stability, solvent resistance, electrical insulation, workability, low gas permeability, and low hygroscopicity are general substrate properties required of the transparent substrate 10.

Preferably, the transparent anode 21 has a light permeability at least equal to or higher than 50%, and preferably equal to or higher than 70% in the visible light wavelength range of 400 nm–700 nm. To form the transparent anode 21, a thin film may be used, which as a material is formed from compounds known as transparent electrode materials such as tin oxide, indium tin oxide, and indium zinc oxide, or metals with a high work function such as gold and platinum. Organic compounds such as polyaniline, polythiophene, polypyrrole, or derivatives of the same, may also be used. Details of transparent conductive films are described in Yutaka Sawada, NEW DEVELOPMENT IN TRANSPARENT CONDUCTIVE FILMS, CMC Publishing Co., Ltd. (1999), and can be applied to the present invention. The transparent anode 21 may be formed onto the transparent substrate 10 by a vacuum deposition method, sputtering method, or ion plating method.

The organic compound layer 22 may have either a single layer configuration comprising the light emitting layer alone or a multiple layer configuration comprising other appropriate layers in addition to the light emitting layer, such as a hole injection layer, a hole transport layer, an electron injection layer, and/or an electron transport layer. A specific configuration of the organic compound layer 22 (including electrodes) may be one of the following: anode/hole injection layer/hole transport layer/light emitting layer/electron transport layer/cathode; anode/light emitting layer/electron transport layer/cathode; or anode/hole transport layer/light emitting layer/electron transport layer/cathode. It is also possible that more than one light emitting layer, hole transport layer, hole injection layer, and/or electron injection layer may be provided.

Each layer in the organic compound layer 22 can be formed by sequentially forming and laminating thin films by vapor deposition of low-molecular weight organic materials, beginning with the layer at the transparent anode 21 side. In this event, use of a deposition mask makes the forming of patterning simple to achieve.

The metal cathodes 23 are preferably formed of a metallic material such as, for example, an alkali metal, such as Li or K with low work functions; an alkaline-earth metal such as Mg or Ca; or an alloy or a mixture of one or more of these metals with Ag or Al. In order to maintain both storage stability and electron injection properties in the cathode, the electrode formed of the aforementioned material may be further coated with Ag, Al, or Au having high work functions and high conductivity. The metal cathodes 23, may be formed, like the transparent anode 21, by a known method such as a vacuum deposition method, a sputtering method, or an ion plating method.

The SLA30 comprises plural SELFOC lenses 31. Each SELFOC lens 31 is a rod-like, thick lens having a refractive index profile in the radial direction as viewed in a cross section thereof. Light incident on the SELFOC lens 31 proceeds, meandering in the form of a sine wave, along the optical axis of the lens towards the photosensitive material 40, and then forms an image of exposure spot 70 at the surface of the photosensitive material 40.

In order to focus the exposure spot and suppress optical crosstalk, apertures of the SELFOC lenses 31 are formed to be larger than the light emitting area of each light emitting section in the organic electroluminescence device 20. Further, adjacent SELFOC lenses 31 are disposed in an array such that they are in contact with each other. The SELFOC lenses 31 may be disposed in one-to-one correspondence to the light emitting sections. Alternatively, each SELFOC lens 31 may be disposed so as to correspond to plural light emitting sections with one or two lenses 31 disposed so as to correspond to sets of the light emitting sections 20R, 20G and 20B arrayed in the secondary scanning direction.

Description will now be made of an arrangement of each of the light emitting sections in the organic electroluminescence device 20.

Figure 2:
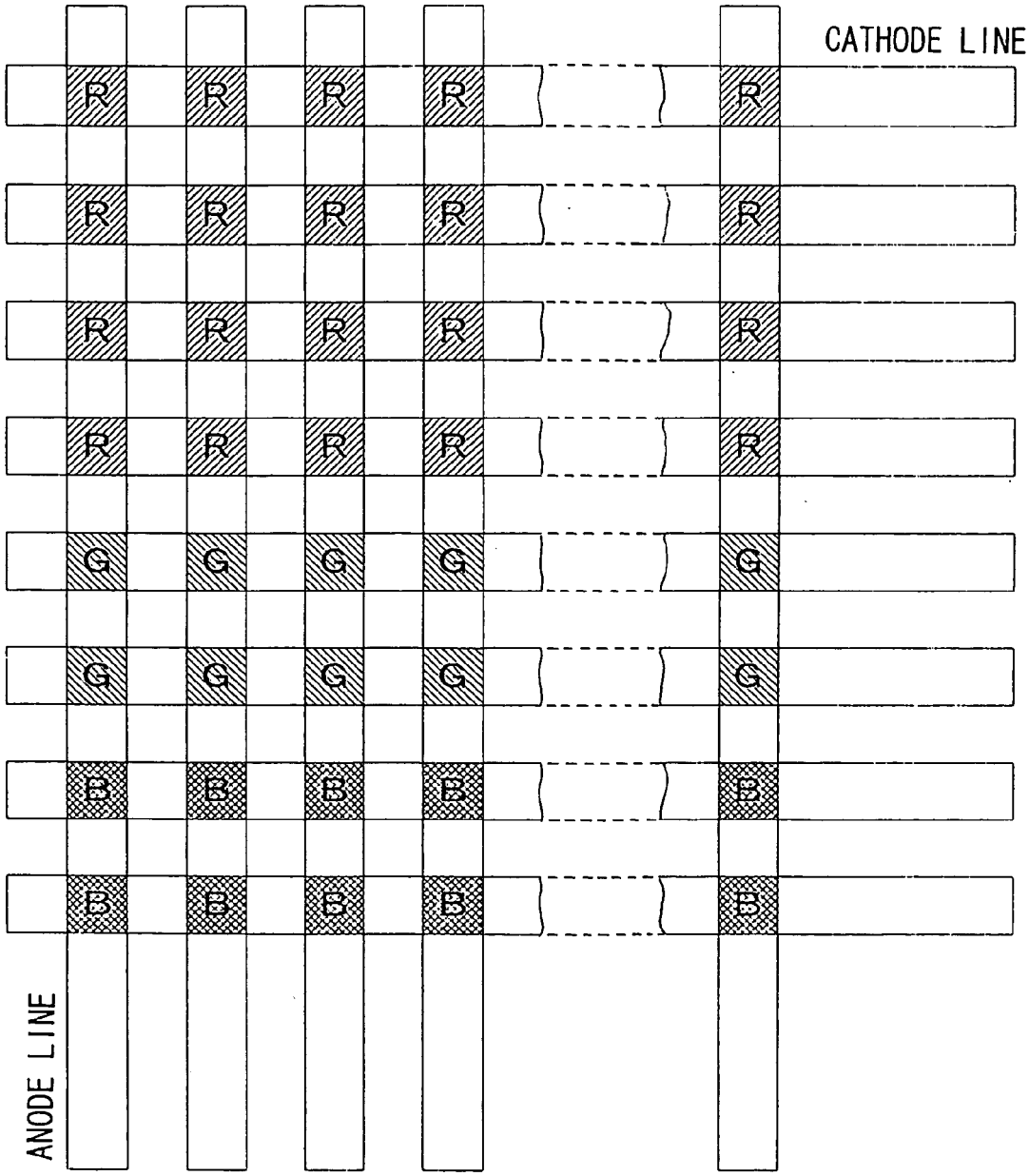
FIG. 2 is a plan view showing a pattern for forming light emitting sections in an organic electroluminescence device.

The light emitting sections 20R, 20G, and 20B are formed onto the transparent substrate 10 as shown in FIG. 2. More specifically, the plural light emitting sections 20R are arranged in the primary scanning direction at a given interval to form a light emitting section row R, and a plurality of such rows R are arranged in the secondary scanning direction. Similarly, the plural light emitting sections 20G are arranged in the primary scanning direction at a given interval to form a light emitting section row G, and a plurality of such rows G are arranged in the secondary scanning direction. Further, the plural light emitting sections 20B are arranged in the primary scanning direction at given intervals to form a light emitting section array B, and a plurality of such rows B are arranged in the secondary scanning direction. Since generally an organic electroluminescence device has a lower light emission intensity for red color R, it is preferred that a larger number of the light emitting section rows R be provided. In this embodiment, four light emitting section rows R, two light emitting section rows G, and two light emitting section rows B are arranged in the secondary scanning direction in the order of RGB so that a total of eight light emitting sections are arranged in the secondary scanning direction.

With the exposure apparatus configured as described above: the light emitted from each of the light emitting sections (20R, 20G, 20B) of the organic electroluminescence device 20 which are arranged in the secondary scanning direction is collected by the SLA30; the corresponding position on the photosensitive material 40 is exposed; and the exposure spot 70 is formed. Displacement of the exposure apparatus relative to the photosensitive material 40 in the secondary scanning direction results in the photosensitive material 40 being scan-exposed.

Description will now be made of the pitch in the secondary scanning direction of each light emitting section.

Each of the plural light emitting sections is subjected to passive driving by means of the driving circuit (not shown), as described above. The term "passive drive" is used herein to refer to a drive system wherein the light emitting section rows (cathode lines) along the metal cathodes are scanned on a time-division and line-sequential basis, and light emitting section rows (anode lines) intersecting with the cathode line being scanned are driven in accordance with a driving signal, as a result of which the scan spreads sequentially over all the cathode lines.

When a plurality of cathode lines are sequentially illuminated for a light emission time t in the same direction as the secondary scanning direction, a pitch T in the secondary scanning direction of each light emitting section is set up as given by the following equation (1) by prior consideration of the movement amount and direction of the cathode lines, i.e. the amount of movement in the secondary scanning direction and the movement direction of the exposure apparatus:

$$T=(m-1/n)P \tag{1}$$

where in the equation (1), P is a pitch of exposure pixels, m is an integer equal to or greater than 2, and n is the number of the light emitting sections arranged in the secondary scanning direction. Each pixel is exposed n times (subjected to multiple-exposure) with the n light emitting sections arranged in the secondary scanning direction.

Figure 3A:
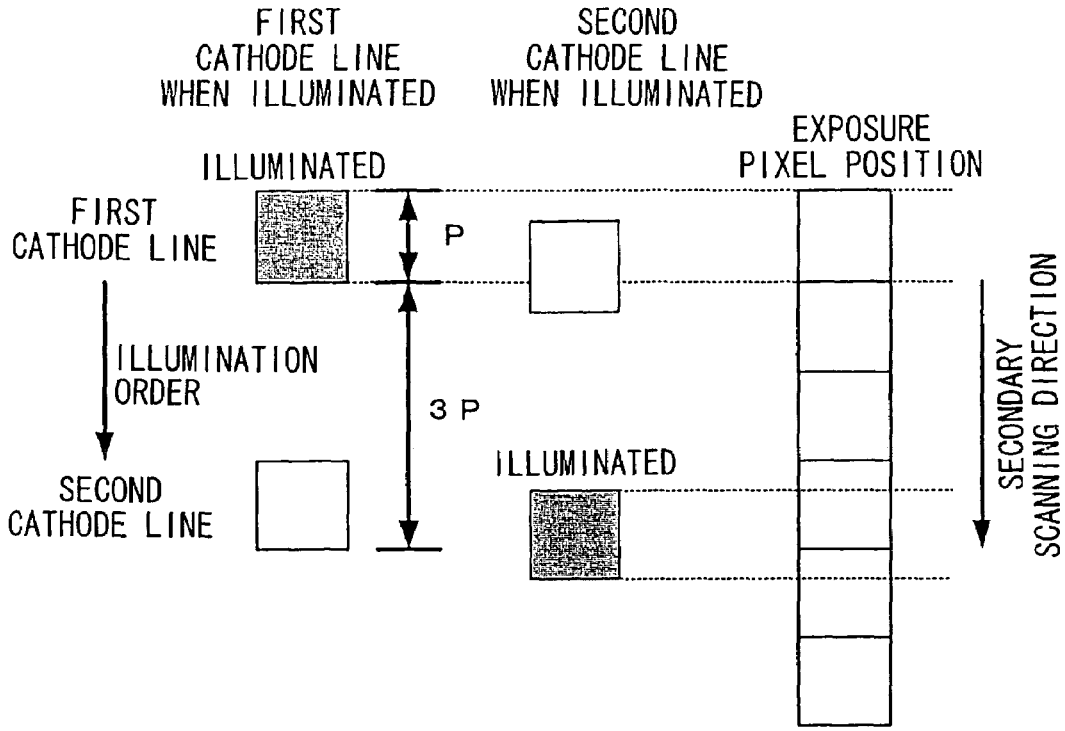
FIG. 3A is a schematic view illustrating a positional relationship between cathode lines and exposure pixels for a case where a pitch T of the cathode lines is set up to be an integral multiple of a pitch P of the exposure pixels.

As shown in FIG. 3, in a case where the pitch T between a first and a second cathode line which are sequentially illuminated is set as an integral multiple of the pitch P of the exposure pixel (three times in FIG. 3), a target pixel position on the photosensitive material can be exposed when the first cathode line is illuminated. However, when the first cathode line is nonilluminated and the second cathode line is illuminated after a lapse of t seconds, the second cathode line has moved by P/n in the secondary scanning direction, as a result of which a position shifted by P/n from the target pixel position toward the downstream side in the secondary scanning direction, is exposed.

In the case where one primary scanning line is exposed with one cathode line (in an active drive system), it is only required that the cathode line be moved by the exposure pixel pitch P in order that the amount of movement in the secondary scanning direction of the cathode line becomes P/n. In a passive drive system, when one primary scanning line is multiple exposed with n cathode lines, the light emitting time t of each cathode line becomes 1/n of the light emitting time in the active drive system. In other words, the secondary scanning velocity v is given by the following equation (3).

$$v=P/(n\cdot t) \tag{3}$$

Figure 3B:
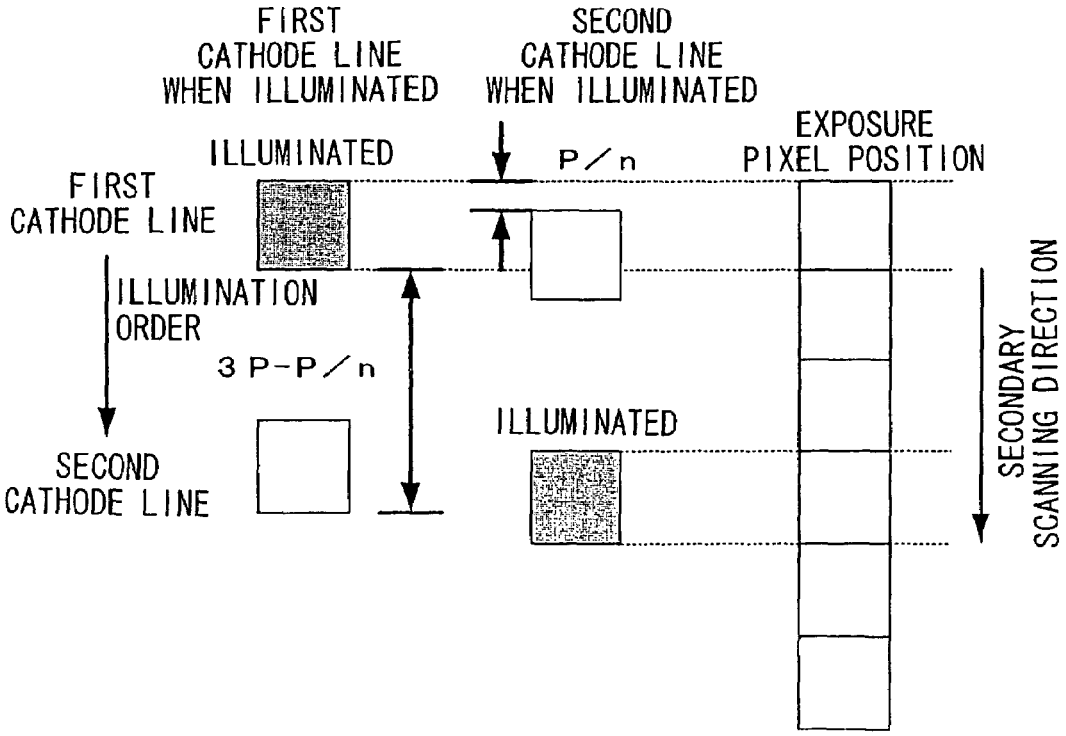
FIG. 3B is a schematic view illustrating a positional relationship between cathode lines and exposure pixels for a case where a pitch T of the cathode lines is determined according to equation (1) given below.

In the case where the pitch T is set up as expressed by the above equation (1), as shown in FIG. 3B, the target exposure pixel can be exposed even when the second cathode line is illuminated, so that any decrease in resolution due to the exposure position being shifted can be prevented.

Figure 4A:
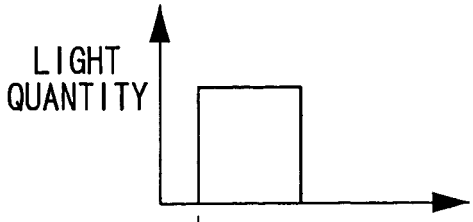
FIG. 4A is a graph showing a quantity of light emitted when cathode lines are illuminated in the case of active drive.
Figure 4B:
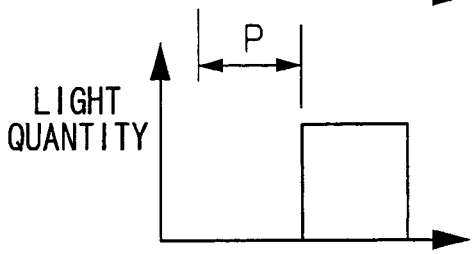
FIG. 4B is a graph showing a quantity of light emitted when cathode lines are non-illuminated in the case of active drive.
Figure 4C:
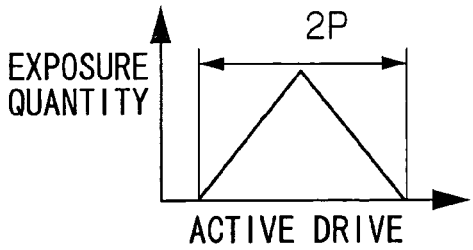
FIG. 4C is a graph showing a distribution profile of exposure quantity on a surface of a photosensitive material in the case of active drive.
Figure 5A:
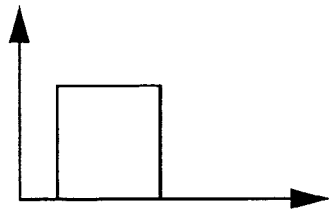
FIG. 5A is a graph showing a quantity of light emitted when cathode lines are illuminated in the case of passive drive.
Figure 5B:
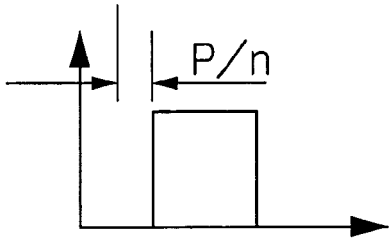
FIG. 5B is a graph showing a quantity of light emitted when cathode lines are non-illuminated in the case of passive drive.
Figure 5C:
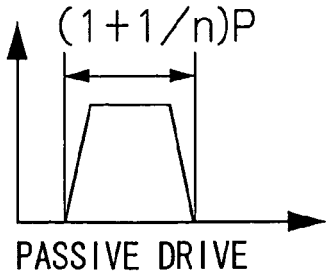
FIG. 5C is a graph showing a distribution profile of exposure quantity on a surface of a photosensitive material in the case of passive drive.

In the active drive system, as shown in FIGS. 4A and 4B, since the cathode line is illuminated while it is moved by the pitch P, the exposure is performed with an exposure quantity profile shown in FIG. 4C, so that the exposure pixel becomes a shape extending in the secondary scanning direction. In the passive drive system, on the other hand, since the cathode line is illuminated only when it is moved by P/n, as shown in FIGS. 5A and 5B, a narrower exposure quantity profile occurs as shown in FIG. 5C, which results in an enhanced resolution.

As discussed above, in the exposure apparatus according to this embodiment, a shift of the exposure position in the secondary scanning direction can be prevented since the pitch in the secondary scanning direction of each light emitting section is determined by prior consideration of the amount of movement in the secondary scanning direction and the direction of movement of the exposure apparatus so that a target pixel position can be exposed even when the exposure apparatus is moved. Another advantage is that multiple exposure can be performed with a higher resolution by virtue of the fact that the exposure quantity profile in the secondary scanning direction becomes narrower since the exposure is made on the basis of passive drive.

In the above embodiment, description has been made of a case where the plural cathode lines are sequentially illuminated during the light emitting time period t in the same direction as the secondary scanning direction. In contrast, when the plural cathode lines are sequentially illuminated in a direction opposite to the secondary scanning direction, the pitch T in the secondary scanning direction of each light emitting section is determined by the following equation (2).

$$T=(m+1/n)P \tag{2}$$

Figure 6A:
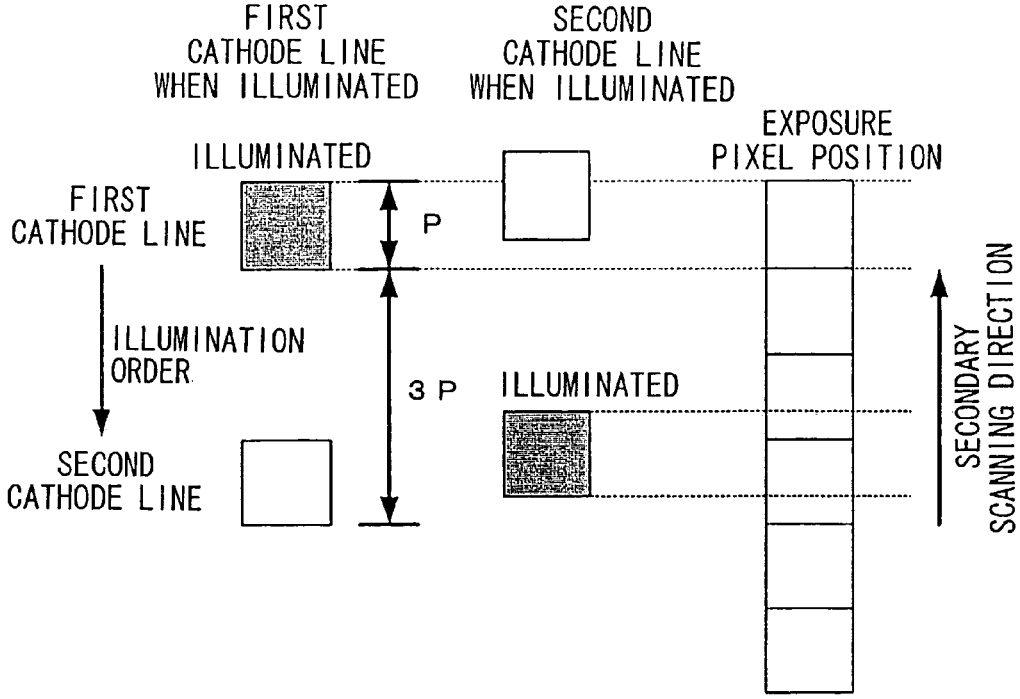
FIG. 6A is a schematic view illustrating a positional relationship between cathode lines and exposure pixels for a case where a pitch T of the cathode lines is set as an integral multiple of a pitch P of the exposure pixels.
Figure 6B:
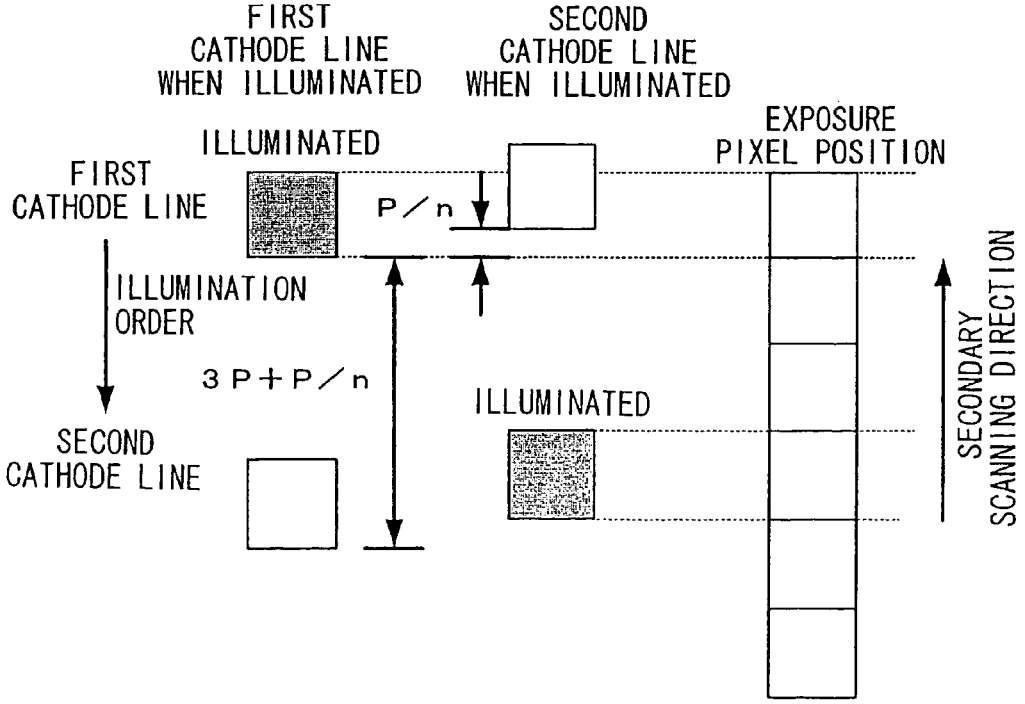
FIG. 6B is a schematic view illustrating a positional relationship between cathode lines and exposure pixels for the case where a pitch T of the cathode lines is determined according to equation (2) given below.

In a case where the pitch T is set as an integral multiple of the pitch P, as shown in FIG. 6A, a target pixel position in the secondary scanning direction can be exposed when the first cathode line is illuminated, while when the second cathode line is illuminated, a position shifted by P/n from the target pixel position toward the upstream side in the secondary scanning direction, is exposed. In contrast, in a case where the pitch T is set by the above equation (2), as shown in FIG. 6B, the target pixel position can be exposed even when the second cathode line is illuminated, as a result of which any decrease in the resolution due to the exposure position being shifted, can be prevented.

Figure 7:
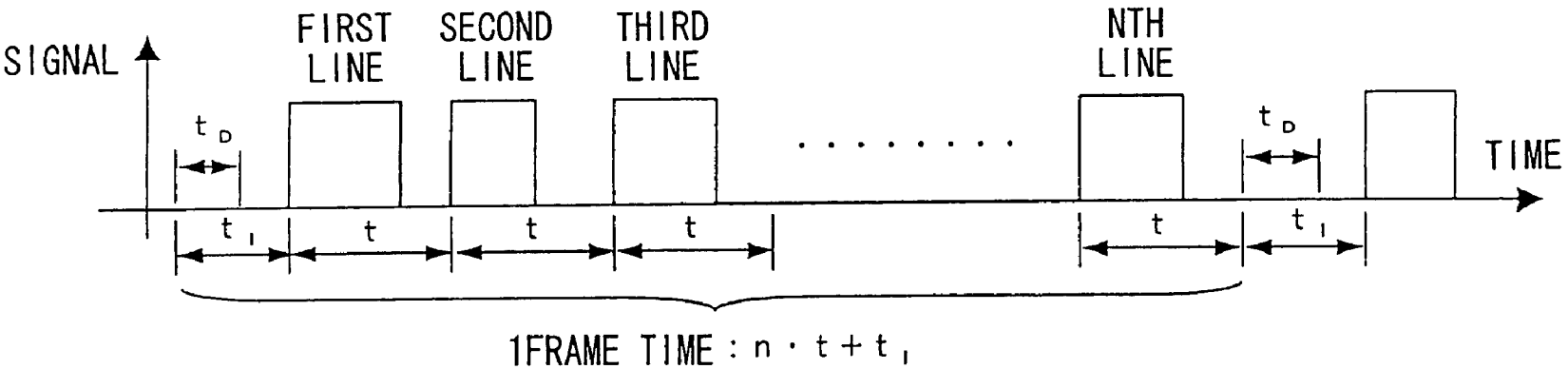
FIG. 7 is a chart showing a light emission timing for each light emitting section on a frame-by-frame basis.
Figure 8:
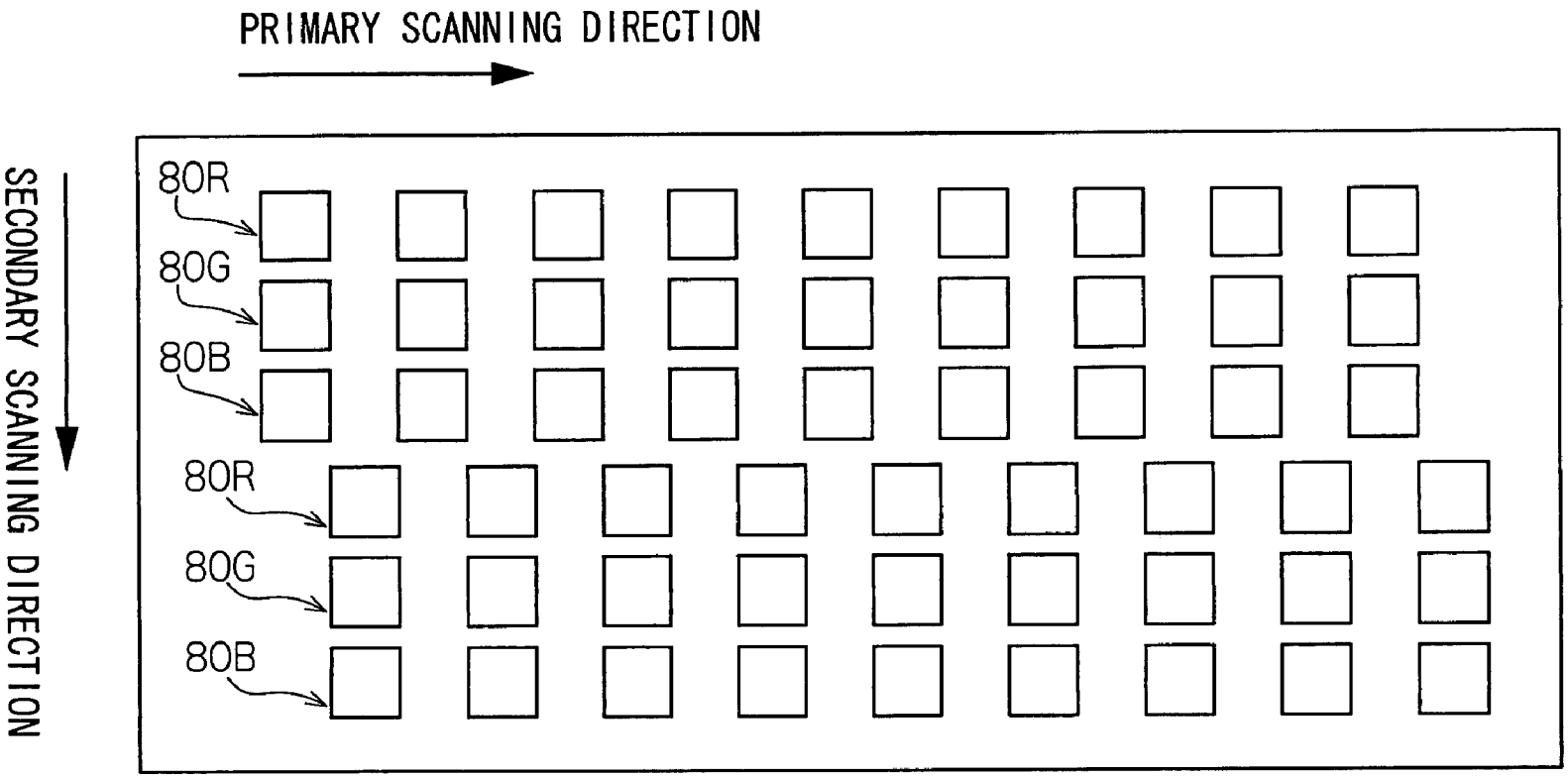
FIG. 8 shows a construction of a conventional exposure apparatus using an organic electroluminescence device.

In the foregoing embodiment, the plural cathode lines were sequentially illuminated with a light emitting time interval t. However, in the actual driving sequence, as shown in FIG. 7, a interval time $t_1$ is inserted between frames in consideration of a transfer time $t_D$ for transferring one frame data in every frame. The interval time $t_1$ is set as a value greater than a maximum value $Max(t_D)$ of the transfer time $t_D$. If exposure were performed without consideration of the interval time $t_1$, a pixel position to be exposed would be shifted by $v \cdot t_1$ every one frame, so that the resolution would be decreased because of the exposure position being shifted. Accordingly, it is necessary to correct the position shift of an exposure pixel with respet to the foregoing interval time $t_1$.

Assuming that the time, including the interval time $t_1$ as well, required to perform exposure on the basis of one frame data is "one frame time", the one frame time becomes $n \cdot t + t_1$. By designing the exposure apparatus (head) such that it is moved by the exposure pixel pitch P every one frame time, it is possible to absorb the amount of shift due to the interval time $t_1$ over the entire one frame time, thereby minimizing the position shift of the exposure pixel. The movement velocity (the secondary scanning speed after the correction) v' of the head in this case is expressed by the following equation (6):

$$v' = P/(n \cdot t + t_1) \tag{6}$$

Accordingly, a pitch T' in the secondary scanning direction of each light emitting section is given by the following equation:

$$T' = m \cdot P \pm v' \cdot t$$

By substituting the value of v' in the above equation, the following equation (7) can be obtained:

$$T' = \{m \pm t/(n \cdot t + t_1)\}P \tag{7}$$

When the plural cathode lines are sequentially illuminated with a light emitting time interval t in the same direction as the secondary scanning direction, a pitch T' in the secondary scanning direction of each light emitting section is determined from the following equation (4). When the plural cathode lines are illuminated in the opposite direction to the secondary scanning direction, a pitch T' in the secondary scanning direction of each light emitting section is determined from the following equation (5).

$$T' = \{m - t/(n \cdot t + t_1)\}P \tag{4}$$

$$T' = \{m + t/(n \cdot t + t_1)\}P \tag{5}$$

As discussed above, the pitch T' in the secondary scanning direction of each light emitting section is determined in previous consideration of the interval time between frames as well in addition to the amount of movement in the secondary scanning direction and the direction of movement of the exposure apparatus, thereby making it possible to minimize the shift of the exposure position in the secondary scanning direction. Further, since the exposure is performed by passive drive, the exposure quantity profile in the secondary scanning direction is narrowed so that high-resolution multiple exposure becomes possible.

Allocation of gradations to each cathode line is effected independently for each color. An example will be described wherein a total of sixteen light emitting section rows are arranged including eight light emitting section rows R, four light emitting section rows G, and four light emitting section rows B. Assuming that the number of bits of image data is b, the number of bits a for driving each cathode line is given by a=b−n. Further, assuming that the number of gradations for a certain exposure pixel is k and that $k<2^b$, the number of gradations for each cathode line for exposing this pixel becomes $k/2^a$.

When the number of bits for driving each cathode line is b=8 bits (256 gradations), n=4, and k=200, for example, the number of gradations for each cathode line becomes $200/2^{8-4}=12.5$. Since the decimal fraction cannot be realized as gradation, the fractional portion (200−12×16=8) is allocated to each cathode line on a one-by-one basis. In this case, one pixel can be exposed with 200 gradations by exposing the first to eighth cathode lines with 13 gradations, and exposing the ninth to sixteenth cathode lines with 12 gradations.

In the above-mentioned allocation procedures, gradations can be allocated to each cathode line substantially uniformly, and eccentric driving that extends the exposure time for some of the light emitting sections, can be avoided, thereby making the degradation rate of each light emitting section substantially constant. Consequently, the life of the exposure apparatus can be improved as a whole.

Although in the foregoing embodiment, description has been made of the use of an organic electroluminescence device by way of example, it is also possible to use an inorganic electroluminescence device or LED device. However, when using organic electroluminescence device, the exposure apparatus can be driven with a lower voltage than when using inorganic electroluminescence device Furthermore, the use of an organic electroluminescence device is advantageous over the use of LED device in that since all light emitting devices can be formed together by vapor deposition, each of them can be located accurately at a predetermined position with ease, and thus variations in light quantity among the devices can be minimized.

As will be appreciated from the above discussion, according to the present invention, it is possible to produce effects such that a shift of an exposure position in the secondary scanning direction can be prevented so that exposure with an enhanced resolution can be achieved.

While the present invention has been illustrated and described with respect to some specific embodiments thereof, it to be understood that the present invention is by no means limited thereto and encompasses all changes and modifications which will become possible within the scope of the appended claims.

What is claimed is:

1. An exposure apparatus, comprising:

a light emitting device array in which a plurality of light emitting devices capable of being controlled and driven independently are arranged in a primary scanning direction to form a device row and a plurality of the device rows are arranged in a secondary scanning direction intersecting with the primary scanning direction, such that the light emitting devices are aligned in the secondary scanning direction with respect to a photosensitive material in the secondary scanning direction; and a drive-control device for driving and controlling each of the light emitting devices so as to cause the plurality of device rows arranged in the secondary scanning direction to be sequentially illuminated on a time-division basis;

wherein when the plurality of device rows are illuminated in a direction identical to the secondary scanning direction, the device rows are arranged with a pitch that is expressed by an equation (1) given below, and when the plurality of device rows are illuminated in a direction opposite to the secondary scanning direction, the device rows are arranged with a pitch T that is expressed by an equation (2) given below, $$T=(m-1/n)P \quad (1)$$

$$T=(m+1/n)P \quad (2)$$

where P is a pitch of an exposure pixel, m is an integer equal to or greater than 2, and n is a number of the device rows arranged in the secondary scanning direction.

2. The exposure apparatus according to claim 1, wherein the photosensitive material is scan-exposed with a secondary scanning velocity v that is expressed by an equation (3) given below, $$v=P/(n\cdot t) \quad (3)$$

where P is a pitch of an exposure pixel, m is an integer equal to or greater than 2, and t is a light emitting time of each device row.

3. The exposure apparatus according to claim 1, wherein the light emitting devices comprise light emitting sections of an organic electroluminescence device.

4. The exposure apparatus according to claim 2, wherein the light emitting devices comprise light emitting sections of an organic electroluminescence device.

5. An exposure apparatus, comprising:

a light emitting device array in which a plurality of light emitting devices capable of being controlled and driven independently are arranged in a primary scanning direction to form a device row and a plurality of the device rows are arranged in a secondary scanning direction intersecting with the primary scanning direction, such that the light emitting devices are aligned in the secondary scanning direction with respect to a photosensitive material; and a drive-control device for driving and controlling each of the light emitting devices so as to cause the plurality of device rows arranged in the secondary scanning direction to be sequentially illuminated on a time-division basis;

wherein when the plurality of device rows are illuminated in a direction identical to the secondary scanning direction, the device rows are arranged with a pitch that is expressed by an equation (4) given below, and when the plurality of device rows are illuminated in a direction opposite to the secondary scanning direction, the device rows are arranged with a pitch T' that is expressed by an equation (5) given below, $$T'=\{m-1/(n\cdot t+t_1)\}P \quad (4)$$

$$T'=\{m+1/(n\cdot t+t_1)\}P \quad (5)$$

where P is a pitch of an exposure pixel, m is an integer equal to or greater than 2, n is a number of the device rows arranged in the secondary scanning direction, t is a light emitting time of each device row, and $t_1$ is an interval time between frames.

6. The exposure apparatus according to claim 5, wherein the photosensitive material is scan-exposed with a secondary scanning velocity v' that is expressed by an equation (6) given below, $$v'=P/(n\cdot t+t_1) \quad (6)$$

where P is a pitch of an exposure pixel, m is an integer equal to or greater than 2, n is a number of the device rows arranged in the secondary scanning direction, t is a light emitting time of each device row, and $t_1$ is an interval time between frames.

7. The exposure apparatus according to claim 5, wherein the light emitting devices comprise light emitting sections of an organic electroluminescence device.

8. The exposure apparatus according to claim 6 wherein the light emitting devices comprise light emitting sections of an organic electroluminescence device.

9. An exposure apparatus, comprising:

a light emitting device array in which a plurality of light emitting devices comprising light emitting sections formed onto a transparent substrate with a predetermined pattern and capable of being controlled and driven independently are arranged in a primary scanning direction to form a device row and a plurality of the device rows are arranged in a secondary scanning direction intersecting with the primary scanning direction, such that the light emitting devices are aligned in the secondary scanning direction with respect to a photosensitive material;

a drive-control device for driving and controlling each of the light emitting devices so as to cause the plurality of device rows arranged in the secondary scanning direction to be sequentially illuminated on a time-division basis; and an exposure spot forming device for providing images on a surface of the photosensitive material by focusing light emitted from the light emitting devices and then permeated through the transparent substrate;

wherein when the plurality of device rows are illuminated in a direction identical to the secondary scanning direction, the device rows are arranged with a pitch that is expressed by an equation (1) given below, and when the plurality of device rows are illuminated in a direction opposite to the secondary scanning direction, the device rows are arranged with a pitch T that is expressed by an equation (2) given below, $$T=(m-1/n)P \quad (1)$$

$$T=(m+1/n)P \quad (2)$$

where P is a pitch of an exposure pixel, m is an integer equal to or greater than 2, and n is a number of the device rows arranged in the secondary scanning direction; and wherein the photosensitive material is scan-exposed with a secondary scanning velocity v that is expressed by an equation (3) given below, $$v=P/(n\cdot t) \quad (3)$$

where P is a pitch of an exposure pixel, m is an integer equal to or greater than 2, n is a number of the device rows arranged in the secondary scanning direction, and t is a light emitting time of each device row.

10. The exposure apparatus according to claim 9, wherein the light emitting devices comprise light emitting sections of an organic electroluminescence device.

11. The exposure apparatus according to claim 10, wherein the drive-control device comprises a driving circuit connected to electrodes of the organic electroluminescence device, and a control section connected to the driving circjuit, wherein driving signal is generated based on a control signal entered from the control section, thereby independently driving each of the plurality of light emitting devices comprising the light emitting sections of the organic electroluminescence device.

12. The exposure apparatus according to claim 9, wherein the exposure spot forming device comprises an array of a plurality of SELFOC lenses, and light incident on the SELFOC lenses is irradiated toward the photosensitive material to be focused to form an image on a surface of the photosensitive material.

13. The exposure apparatus according to claim 10, wherein the organic electroluminescence device is sealed by a sealing member having a marginal portion thereof adhered to the transparent substrate.

14. An exposure apparatus, comprising:

a light emitting device array in which a plurality of light emitting devices comprising light emitting sections formed onto a transparent substrate with a predetermined pattern and capable of being controlled and driven independently are arranged in a primary scanning direction to form a device row and a plurality of the device rows are arranged in a secondary scanning direction intersecting with the primary scanning direction, such that the light emitting devices are aligned in the secondary scanning direction with respect to a photosensitive material;

a drive-control device for driving and controlling each of the light emitting devices so as to cause the plurality of device rows arranged in the secondary scanning direction to be sequentially illuminated on a time-division basis; and an exposure spot forming device for providing images on a surface of the photosensitive material by focusing light emitted from the light emitting devices whne illuminated and then permeated through the transparent substrate;

wherein when the plurality of device rows are illuminated in a direction identical to the secondary scanning direction, the device rows are arranged with a pitch that is expressed by an equation (4) given below, and when the plurality of device rows are illuminated in a direction opposite to the secondary scanning direction, the device rows are arranged with a pitch T' that is expressed by an equation (5) given below, $$T'=\{m-1/(n\cdot t+t_1)\}P \quad (4)$$

$$T'=\{m+1/(n\cdot t+t_1)\}P \quad (5)$$

where P is a pitch of an exposure pixel, m is an integer equal to or greater than 2, n is a number of the device rows arranged in the secondary scanning direction, t is a light emitting time of each device row, and $t_1$ is an interval time between frames; and wherein the photosensitive material is scan-exposed with a secondary scanning velocity v' that is expressed by an equation (6) given below, $$v'=P/(n\cdot t+t_1) \quad (6)$$

where P is a pitch of an exposure pixel, m is an integer equal to or greater than 2, n is a number of the device rows arranged in the secondary scanning direction, t is a light emitting time of each device row, and $t_1$ is an interval time between frames.

15. The exposure apparatus according to claim 14, wherein the light emitting device array comprises an organic electroluminescene device.

16. The exposure apparatus according to claim 15, wherein the drive-control device comprises a driving circuit connected to electrodes of the organic electroluminescence device, and a control section connected to the driving circjuit, wherein driving signal is generated based on a control signal entered from the control section, thereby independently driving each of the plurality of light emitting devices comprising the light emitting sections of the organic electroluminescence device.

17. The exposure apparatus according to claim 14, wherein the exposure spot forming device comprises an array of a plurality of SELFOC lenses, and light incident on the SELFOC lenses is irradiated toward the photosensitive material and focused to form an image on a surface of the photosensitive material.

18. The exposure apparatus according to claim 15, wherein the organic electroluminescence device is sealed by a sealing member having a marginal portion thereof adhered to the transparent substrate.

* * * * *